US008505768B2

(12) United States Patent
Bardwell et al.

(10) Patent No.: US 8,505,768 B2
(45) Date of Patent: Aug. 13, 2013

(54) FOOD TRAY

(75) Inventors: Michele E. Bardwell, Lake Elmo, MN (US); Neal P. Barnes, Medina, MN (US)

(73) Assignee: Envionmental Dining, LLC, Lake Elmo, MN (US)

( * ) Notice: Subject to any disclaimer, the term of this patent is extended or adjusted under 35 U.S.C. 154(b) by 610 days.

(21) Appl. No.: 12/629,635

(22) Filed: Dec. 2, 2009

(65) Prior Publication Data

US 2011/0127190 A1 Jun. 2, 2011

(51) Int. Cl.
*B65D 43/16* (2006.01)

(52) U.S. Cl.
USPC ..... 220/832; 220/4.24; 220/4.23; 206/564

(58) Field of Classification Search
USPC ..... 220/810, 4.21, 4.22, 4.24, 832, 831; 206/558, 562, 564
See application file for complete search history.

(56) References Cited

U.S. PATENT DOCUMENTS 2,167,489 A * 7/1939 Renga ..... 16/357
2,718,447 A 9/1955 Wright
D188,583 S 8/1960 Moss
3,179,281 A * 4/1965 Svoboda et al. ..... 220/840
3,186,574 A * 6/1965 Davidson ..... 217/60 D
3,286,300 A * 11/1966 Altemiller ..... 16/326
3,632,161 A 1/1972 Arfaras et al.
3,682,348 A * 8/1972 Roberts ..... 16/343
3,845,875 A * 11/1974 Douglas et al. ..... 220/556
3,999,630 A 12/1976 McPhee
D245,762 S 9/1977 Takacs
4,067,475 A 1/1978 Pinkau et al.
4,159,071 A 6/1979 Roca
4,295,839 A 10/1981 Baker et al.
4,349,120 A * 9/1982 DiNardo ..... 220/840
4,369,883 A * 1/1983 Stravitz ..... 206/387.15
4,545,487 A 10/1985 Asmus
4,549,670 A * 10/1985 Trendler ..... 422/536
4,684,017 A * 8/1987 Watanabe et al. ..... 206/235
D292,445 S 10/1987 Judge
D294,776 S 3/1988 Gander et al.
4,834,449 A 5/1989 Engelman
4,934,549 A * 6/1990 Allen ..... 220/4.24
4,944,552 A 7/1990 Harris
4,958,576 A 9/1990 Kauer
4,967,924 A * 11/1990 Murofushi et al. ..... 220/3.8
D314,085 S 1/1991 Uemura
D314,669 S 2/1991 Kunimune
5,076,460 A * 12/1991 Hussell ..... 220/4.22
5,103,978 A * 4/1992 Secor ..... 206/387.1
5,106,156 A 4/1992 Marquis
D326,226 S 5/1992 Gerhart
5,413,035 A 5/1995 Fernandez
5,430,248 A * 7/1995 Levy ..... 174/50
5,437,493 A 8/1995 Weisleder (Continued)

*Primary Examiner* — Anthony Stashick
*Assistant Examiner* — Christopher McKinley
(74) *Attorney, Agent, or Firm* — Fredrikson & Byron, PA

(57) ABSTRACT

In one aspect, the present invention provides a foldable food tray that includes first and second panels, each having upper and lower surfaces and inner, outer, and side edges. Each panel can also include one or more hinge members and one or more locking members. The hinge member(s) can be operatively coupled to one another to permit the first and second panels to move between a closed position and an open position. The locking member(s) can be configured to releasably lock the first and second panels in the open position, thereby preventing the first and second panels from inadvertently moving from the open position.

10 Claims, 12 Drawing Sheets

(56) References Cited

U.S. PATENT DOCUMENTS

| | | | | |
|---|---|---|---|---|
| 5,460,102 | A * | 10/1995 | Pasmanick | 108/43 |
| 5,547,247 | A | 8/1996 | Dixon | |
| 5,671,846 | A * | 9/1997 | Frank | 206/541 |
| D384,501 | S | 10/1997 | Rosen | |
| D390,357 | S | 2/1998 | Rosen | |
| 5,782,371 | A * | 7/1998 | Baerenwald et al. | 220/4.22 |
| 5,950,834 | A * | 9/1999 | Woodnorth et al. | 206/541 |
| 6,129,229 | A * | 10/2000 | Dunn et al. | 220/4.22 |
| D435,591 | S | 12/2000 | Wyant | |
| 6,186,350 | B1 * | 2/2001 | Barrier et al. | 220/4.22 |
| D439,042 | S | 3/2001 | Lau | |
| D449,164 | S | 10/2001 | Rosen | |
| 6,347,590 | B1 | 2/2002 | D'Annunzio et al. | |
| 6,415,924 | B1 * | 7/2002 | Lee | 206/459.5 |
| 6,431,645 | B2 | 8/2002 | Massara et al. | |
| 6,478,184 | B2 * | 11/2002 | Berge et al. | 220/831 |
| 6,510,946 | B2 * | 1/2003 | Gutierrez et al. | 206/545 |
| 6,574,834 | B2 * | 6/2003 | Fedon | 16/225 |
| 6,637,774 | B2 | 10/2003 | Gaska | |
| 6,675,959 | B1 * | 1/2004 | Chiang | 206/6 |
| 6,685,264 | B2 | 2/2004 | Mullen et al. | |
| D509,247 | S | 9/2005 | Nash | |
| D510,389 | S | 10/2005 | Shamoon | |
| 6,994,031 | B2 | 2/2006 | Huang | |
| D520,562 | S * | 5/2006 | Nash | D19/52 |
| 7,306,282 | B2 | 12/2007 | Salzer et al. | |
| D561,993 | S | 2/2008 | Bum | |
| D565,842 | S | 4/2008 | Falcone | |
| D578,129 | S | 10/2008 | Weber | |
| D586,400 | S | 2/2009 | Shamoon | |
| 8,051,514 | B2 * | 11/2011 | Yarmer et al. | 5/639 |
| 2006/0011624 | A1 * | 1/2006 | Shih | 220/4.24 |
| 2006/0266748 | A1 * | 11/2006 | Crawford | 220/23.8 |
| 2009/0235458 | A1 * | 9/2009 | Yarmer et al. | 5/639 |

* cited by examiner

FOOD TRAY

TECHNICAL FIELD

Some embodiments disclosed herein relate generally to trays for carrying food items.

BACKGROUND

Food trays are used in many settings, such as cafeterias (at colleges and other schools, hospitals, etc.), fast food restaurants, homes, and so on. In many instances, it is significantly easier and more convenient to carry plates, bowls, silverware, drinks, etc. on a single tray, as compared with carrying each item individually.

Recently, more and more food providers are ceasing to offer food trays to their customers. For example, many colleges have eliminated trays from their cafeterias. Washing the trays can consume significant quantities of water, so doing away with trays is seen as a water conservation measure. Other objectives of eliminating trays include cutting food waste, "softening the ambience," saving money, and reducing overeating.

Nevertheless, many food customers would still prefer to have a tray for the convenience benefits noted above.

SUMMARY

Embodiments of the present invention provide compact food trays that customers can bring to eating establishments or other locales for use when trays are not provided. The trays are compactible (e.g., foldable) so that they can be stored in an ordinary bag (e.g., a backpack) for easy transport. Preferred trays according to the present invention can be locked when opened (e.g., unfolded) so that they remain flat when loaded with food items. Many tray embodiments include recessed compartments that may be more conducive to carrying certain kinds of food items, eating utensils, etc.

In some embodiments, the invention provides a portable food tray comprising at least two panels that each define one or more recessed compartments. The tray has an open position and a closed position. In the present embodiments, the tray when in the closed position has a major dimension less than 30 inches long. Further, in the present embodiments, when the tray is in the open position the two noted panels are generally parallel to each other and the recessed compartments of these two panels face the same general direction (or substantially the same direction). Still further, in the present embodiments, the tray when in the open position is releasably locked in that position such that when a person uses the tray to walk with a meal the tray is mechanically locked against inadvertently moving from the open position.

Certain embodiments of the invention provide a foldable food tray. In the present embodiments, the tray comprises a first panel including a first panel upper surface, a first panel lower surface, a first panel inner edge, a first panel outer edge, and first panel side edges. The first panel further includes (i) one or more first panel hinge members and (ii) one or more first panel locking members. The tray comprises a second panel having a second panel upper surface, a second panel lower surface, a second panel inner edge, a second panel outer edge, and second panel side edges. The second panel further includes (i) one or more second panel hinge members and (ii) one or more second panel locking member. The first panel hinge member(s) and the second panel hinge member(s) are operatively coupled to one another to permit the first and second panels to move between (i) a closed position in which the first and second panels are generally parallel to one another and the first panel upper surface and the second panel upper surface are facing one another and (ii) an open position in which the first and second panels are generally parallel to one another and the first panel upper surface and the second panel upper surface are both facing the same general direction (or substantially the same direction). The first panel locking member(s) and the second panel locking member(s) are configured to releasably lock the first and second panels in the open position, thereby preventing the first and second panels from inadvertently moving from the open position.

Certain embodiments provide a foldable food tray comprising a first panel including a first panel upper surface, a first panel lower surface, a first panel inner edge, a first panel outer edge, and first panel side edges. The tray comprises a second panel having a second panel upper surface, a second panel lower surface, a second panel inner edge, a second panel outer edge, and second panel side edges. In the present embodiments, the tray includes hinge means for permitting the first and second panels to move between (i) a closed position in which the first and second panels are generally parallel to one another and the first panel upper surface and the second panel upper surface are facing one another and (ii) an open position in which the first and second panels are generally parallel to one another and the first panel upper surface and the second panel upper surface are both facing the same general direction. The tray in the present embodiments includes locking means for releasably locking the first and second panels in the open position, thereby preventing the first and second panels from inadvertently moving from the open position.

BRIEF DESCRIPTION OF THE DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

Figure 1A:
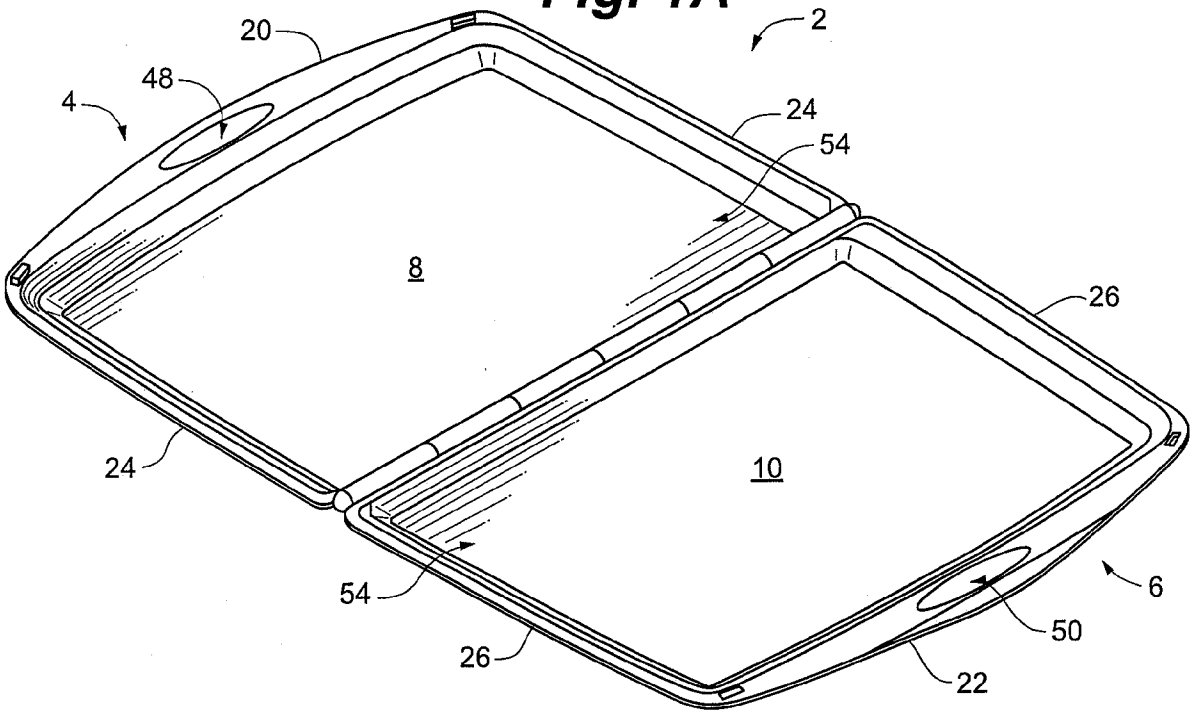
FIG. 1A is a perspective view of a foldable compact food tray according to embodiments of the present invention in an open position.
Figure 1B:
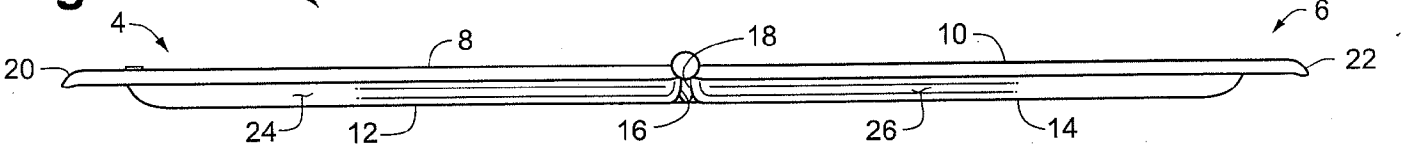
FIG. 1B is a side view of the foldable compact food tray of FIG. 1A in an open position.

The following detailed description is illustrative in nature and is not intended to limit the scope, applicability, or configuration of the invention in any way. Rather, the following description provides practical illustrations for implementing exemplary embodiments of the present invention. Examples of constructions, materials, dimensions, and manufacturing processes are provided for selected elements, and all other elements employ that which is known to those of skill in the field of the invention. Those skilled in the art will recognize that many of the examples provided have suitable alternatives that can be utilized.

The invention provides a portable food tray comprising at least two panels, which optionally each define one or more recessed compartments. The tray may have only two panels, or it may include three or more panels. The tray has an open position (or "deployed position") and a closed position (or "compacted position"). In certain embodiments, when the tray is in its closed position, it has a major dimension of less than 40 inches long, less than 30 inches long, less than 25 inches long, less than 20 inches long, less than 18 inches long, or even less than 15 inches long. Depending on the shape of the tray, its major dimension may be the distance between two opposed corners of the tray, a diameter of the tray, etc. In certain preferred embodiments, the major dimension of the tray when in the closed position is at least 8 inches, at least 10 inches, or at least 11 inches (optionally in combination with any of the maximums noted above). As shown in FIG. 2B, the tray when in its closed position has a flat configuration comprising two opposed exposed planar surfaces 12, 14 that are substantially parallel to each other. When the tray is in its open position, the two noted panels are generally (or substantially) parallel to each other (and optionally lie in the same plane) and the optional recessed compartments of those two panels face the same general direction (or substantially the same direction). In preferred embodiments, the tray when in its open position is releasably locked in that position, e.g., such that when a person uses the tray to walk with a meal, the tray is mechanically locked against inadvertently moving from the open position.

In preferred embodiments, the tray is a foldable tray, optionally having a clam-shell-type design in which the two noted panels are hingedly attached to each other by a hinge system. Preferably, in embodiments where the tray is foldable, when the tray is in the open position, it is locked (e.g., mechanically) against inadvertently folding in either direction away from the open position. In some foldable tray embodiments, the tray has a central hinge system extending along a middle of the tray. In certain embodiments of this nature, the tray is devoid of hinges other than the central hinge system extending along the middle of the tray. In some of these embodiments, when the tray is in the open position, the central hinge system is located between at least two of the optional recessed compartments, and each of these two recessed compartments is configured to receive at least part of a meal for a person. Further, in some embodiments the tray is portable and is not part of any other object (e.g., a chair) but rather can fit inside a backpack.

In alternate embodiments, the tray is not foldable, but rather is telescoping (e.g., one panel telescopes inside the other between compacted and deployed positions). In still other embodiments, the two panels can be separated from each other entirely and positioned in a side-by-side compacted position for storage; then, when it is desired to deploy the tray, the two panels can be releasably attached to each other.

FIGS. 1A-1B and 2A-2B show an illustrative foldable food tray 2. As shown, the tray 2 can include multiple panels 4, 6. In certain embodiments, the tray has only two panels, which can optionally lie in a common plane when the tray is in the open position. As is discussed in greater detail below, the panels 4, 6 optionally are hingedly moveable relative to one another. The panels 4, 6 can be generally flat, with each panel 4, 6 optionally including an upper surface 8, 10, a lower surface 12, 14, an inner edge 16, 18, an outer edge 20, 22, and side edges 24, 26. This edge-naming convention can apply to embodiments like those shown in FIGS. 3A-3H regardless of whether the tray is rectangular, square, round, oval, half-round, etc.

The panels 4, 6 can be formed of different materials, such as plastic, metal, wood, ceramic, etc. In one group of embodiments, the panels are rigid and formed of material that is durable to water (e.g., does not disintegrate, dissolve, breakdown, or otherwise lose rigidity when washed with, or soaked in, water). In certain preferred embodiments, the panels are formed of polypropylene.

The panels 4, 6 can be made using a variety of processes, such as injection molding, thermoforming, or stamping methods (e.g., when the panels are metal). In certain preferred embodiments, the panels are made by injection molding polypropylene.

In some embodiments, a non-slip grip detail can be added to either or both of the upper surfaces 8, 10 to reduce the incidence of food items sliding around when loaded on the tray 2. For example, a coating or other body of rubber, urethane, or the like can be provided.

FIGS. 3A-3H illustrate how the panels 4, 6 can take a variety of shapes. In most embodiments, the footprint (or perimeter) of panel 4 matches (e.g., is substantially identical to) that of panel 6 so that the panels 4, 6 align properly with one another when the tray is closed. In such embodiments, while the footprints of the panels 4, 6 may alternatively be substantially identical, the particular contours and topography of each panel 4, 6 may differ from one another. In some embodiments, the panels 4, 6 are each generally (or substantially) rectangular. Further, in some embodiments, the configuration of the tray itself when in the open position is generally (or substantially) rectangular.

Figure 5A:
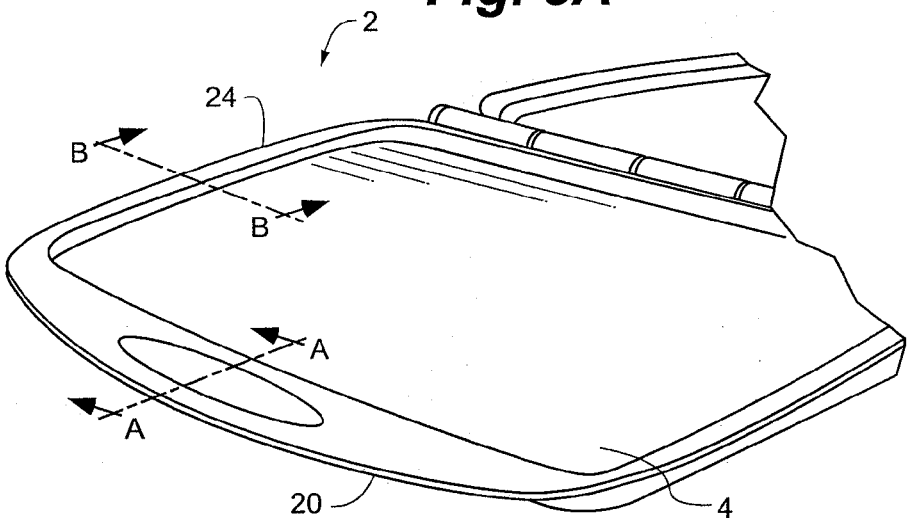
FIG. 5A is a perspective view of a portion of a foldable compact food tray according to embodiments of the present invention in an open position.
Figure 5B:
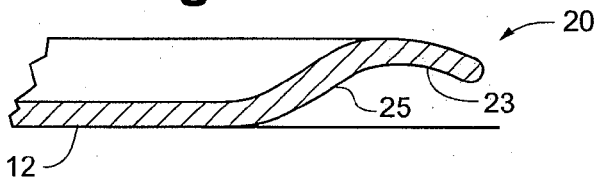
FIG. 5B is an illustrative cross-sectional view of section A-A of FIG. 5A, in accordance with one embodiment.
Figure 5C:
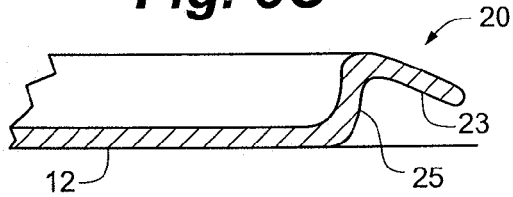
FIG. 5C is an illustrative cross-sectional view of section A-A of FIG. 5A, in accordance with another embodiment.
Figure 5D:
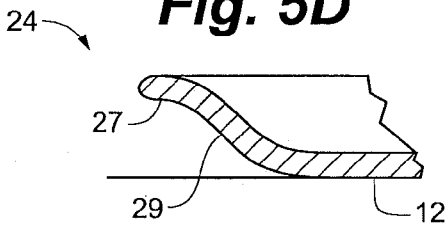
FIG. 5D is an illustrative cross-sectional view of section B-B of FIG. 5A.

FIGS. 5A-5D provide detail of illustrative outer edges 20 and side edges 24 of one of the panels 4. As can be seen, the outer edge 20 can have a riser surface 25 that extends from the lower surface 12 of the panel 4, as well as a ledge surface 23 that extends from the riser surface 25. FIG. 5B shows one configuration of the riser surface 25 and ledge surface 23, and FIG. 5C shows another possible configuration for the riser surface 25 and ledge surface 23. Similarly, as can be seen in FIG. 5D, the side edge 24 can likewise optionally include a ledge surface 27 and a riser surface 29. It should be understood, however, that trays according to the present invention can have a variety of side edge 24 and outer edge 20 configurations.

Figure 6:
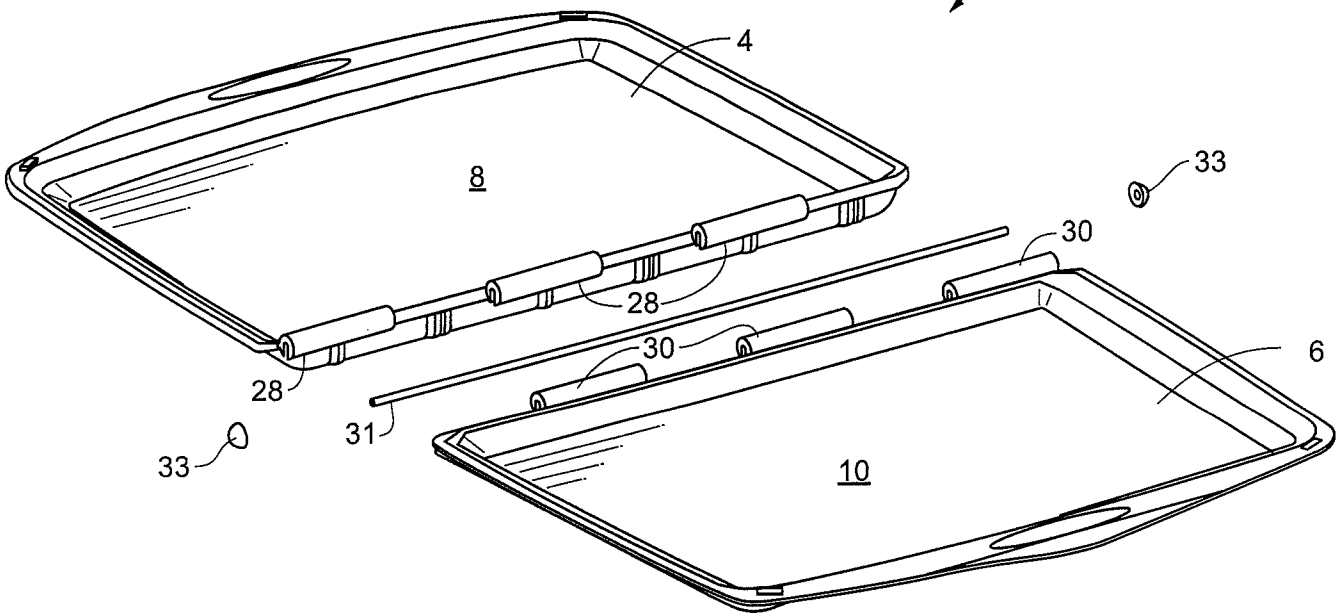
FIG. 6 is an exploded view of a foldable compact food tray according to certain embodiments of the present invention.
Figure 7:
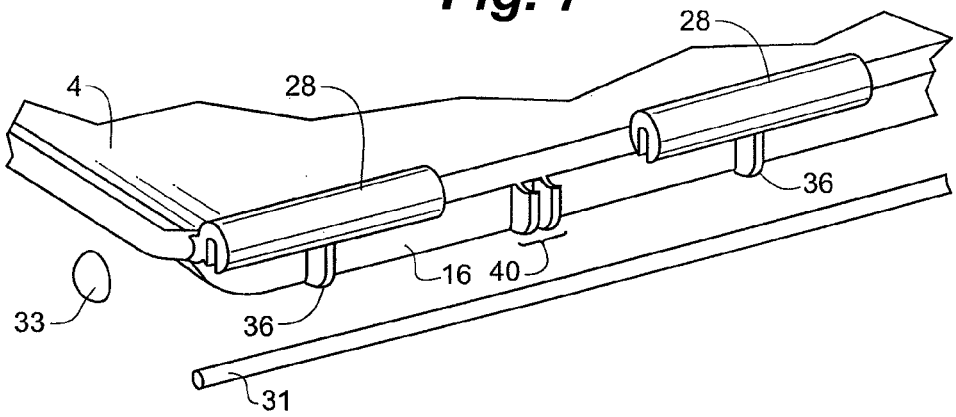
FIG. 7 is an exploded view of a portion of a foldable compact food tray according to other embodiments of the present invention.

As noted, panels 4, 6 can optionally be hingedly coupled to one another to allow the tray 2 to be folded and unfolded. FIG. 6 provides an exploded view of an illustrative tray 2, showing components of an exemplary hinge mechanism (or "hinge system"). Each panel 4, 6 can include one or more hinge members 28, 30. In operation, the hinge members 28, 30 can be operatively coupled to one another. For example, with the hinge members 28, 30 aligned, rod 31 can be passed through openings in each of the hinge members 28, 30 and secured in place by caps 33. FIG. 7 shows another illustrative hinge configuration, with hinge members 28, rod 31, and cap 33. The hinge members 28, 30 can permit the panels 4, 6 to move between a closed position and an open position. In the closed position, the illustrated panels 4, 6 are generally parallel to one another and the upper surfaces 8, 10 of the panels 4, 6 are facing one another. In the open position, the panels 4, 6 are generally parallel to one another and the upper surfaces 8, 10 of the panels 4, 6 are both facing the same general direction (or substantially the same direction). The illustrated panels 4, 6 can move hingedly relative to one another about a hinge axis (e.g., an axis that is coaxial with rod 31), and the tray 2 can be generally symmetric about the hinge axis. The hinge systems shown in the figures are merely exemplary; any type of hinge system can be used.

In one exemplary embodiment, the tray has the configuration shown in FIGS. 1A-2B, the length of the tray when open is 18 inches, the width is about 11.75 inches, the thickness of the open tray is about 0.55 inch, the thickness of the closed tray is about 0.74 inch, the panels are polypropylene, and the hinge system uses a 0.125 inch diameter stainless steel hinge pin. It is to be appreciated, however, that these dimensions and features are merely exemplary; they are by no means limiting to the invention.

Referring again to FIGS. 1A-1B and 2A-2B, each panel 4, 6 can optionally include one or more locking members 32, 34, which can be configured to releasably lock the panels 4, 6 in the open position. This can prevent the panels 4, 6 from inadvertently moving from the open position. For example, when a food customer pulls a tray out of his/her backpack and unfolds it, he/she wants the tray to remain flat. If loading food on the tray causes the tray to fold—either upwardly or downwardly—food will spill. Thus, when the illustrated tray is in its open position, the locking members 32, 34 preferably releasably and mechanically lock the panels 4, 6 against inadvertently folding in either direction away from the open position.

The illustrated locking members 32, 34 can prevent the panels 4, 6 from folding such that the upper surfaces 8, 10 begin to form an angle that is less than 180 degrees (e.g., by three degrees, by five degrees, by ten degrees, etc.) and from folding such that the upper surfaces 8, 10 begin to form an angle that is greater than 180 degrees (e.g., by three degrees, by five degrees, by ten degrees, etc.). In this way, the locking members 32, 34 can provide confidence to users that the tray 2 will remain structurally sound when loaded with food items.

Figure 2A:
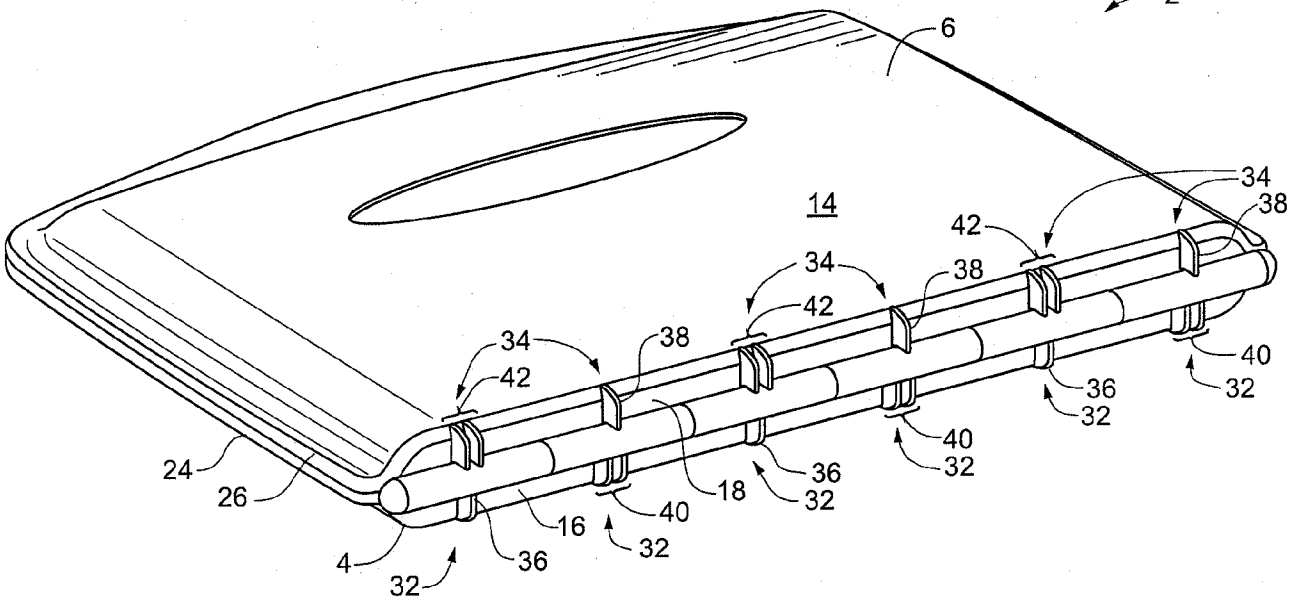
FIG. 2A is a perspective view of the foldable compact food tray of FIG. 1A in a closed position.
Figure 2B:
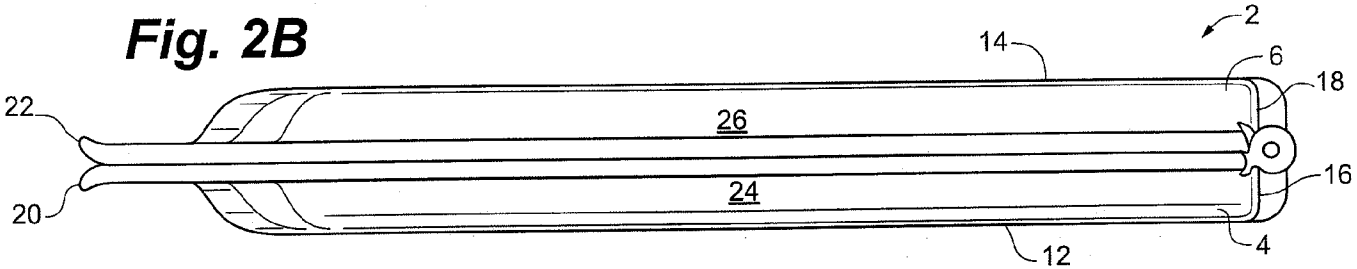
FIG. 2B is a side view of the foldable compact food tray of FIG. 1A in a closed position.
Figure 3A:
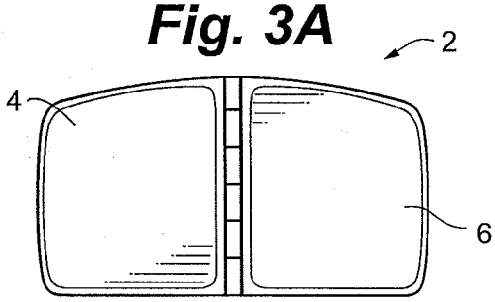
FIGS. 3A-3H are top views of variously shaped foldable compact food trays according to embodiments of the present invention, each in an open position.
Figure 3B:
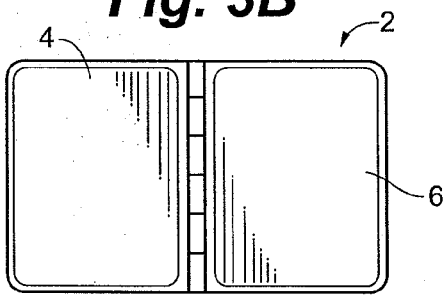
Figure 3C:
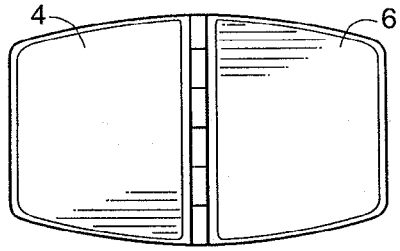
Figure 3D:
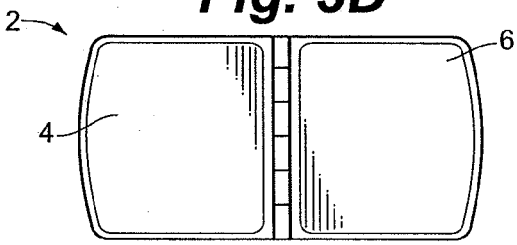
Figure 3E:
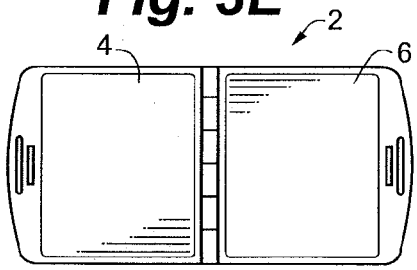
Figure 3F:
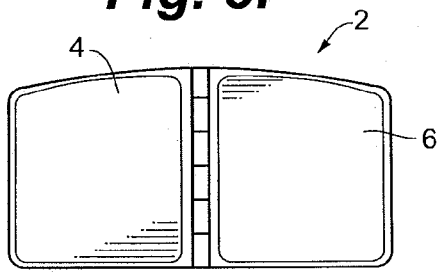
Figure 3G:
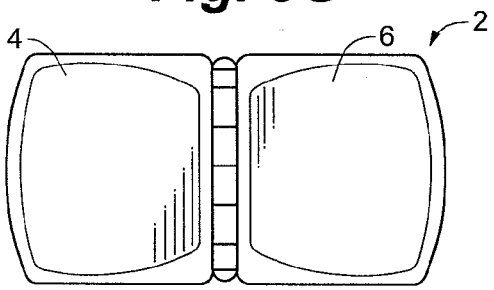
Figure 3H:
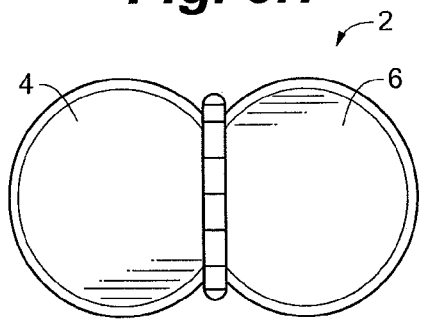
Figure 4A:
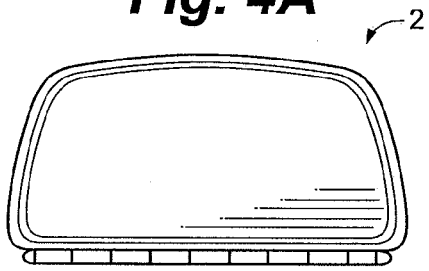
FIGS. 4A-4C are top views of variously shaped foldable compact food trays according to embodiments of the present invention, each in a closed position.
Figure 4B:
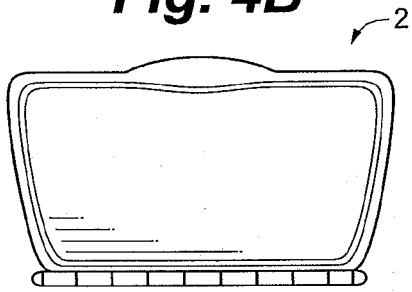
Figure 4C:
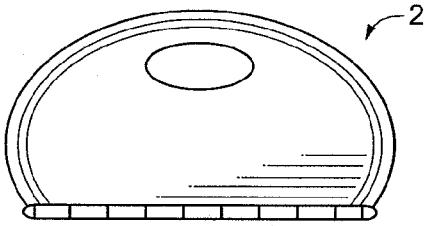
Figure 14:
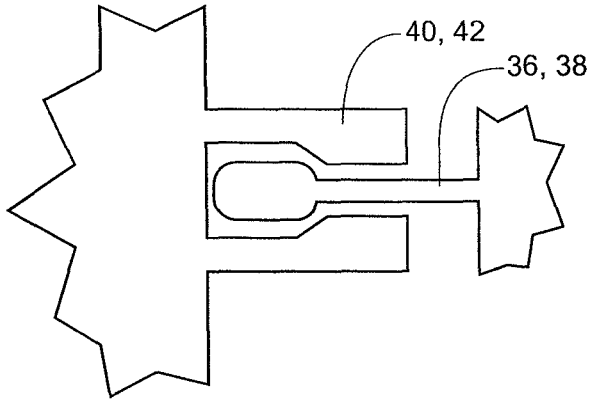
FIG. 14 is a schematic cross-sectional view of engaged locking members in accordance with certain embodiments of the invention.

FIGS. 2A and 7 show an illustrative configuration for the locking members 32, 34, which include single projections 36, 38 that work with corresponding pairs of projections 40, 42. The single projections 36, 38 and the pairs of projections 40, 42 can project away from the inner edges 16, 18 of the respective panels 4, 6. In use, the single projections 36, 38 can cooperate with corresponding pairs of projections 40, 42 to lock the panels 4, 6 in the open position. For example, the friction forces generated by the interconnection between the single projections 36, 38 and the corresponding pairs of projections 40, 42 can be sufficient to withstand ordinary torque exerted by food items. In some embodiments, these friction forces can be enhanced by detent structures projecting from the single projections 36, 38 and corresponding detents on the interior surfaces of the pairs of projections 40, 42. Reference is made to FIG. 14. When a user is ready to unlock the panels 4, 6, he/she can simply supply a torque to the tray that is sufficient to overcome the friction force of the engaged projections 36, 38, 40, 42.

Locking members 32, 34 that include projections can take a variety of forms. Some embodiments can include only one single projection projecting from one of the panels 4, 6, with only one corresponding pair of projections projecting from the other panel 4, 6. Other embodiments can include a plurality of single projections projecting from one of the panels 4, 6, with a corresponding plurality of pairs of projections projecting from the other panel 4, 6. In some embodiments, both panels 4, 6 can include a plurality of single projections 36, 38 and a plurality of pairs of projections 40, 42 positioned alternatingly along the respective inner edges 16, 18. In such embodiments, each single projection 36, 38 cooperates with a corresponding pair of projections 40, 42 to lock the panels 4, 6 in the open position.

Figure 8:
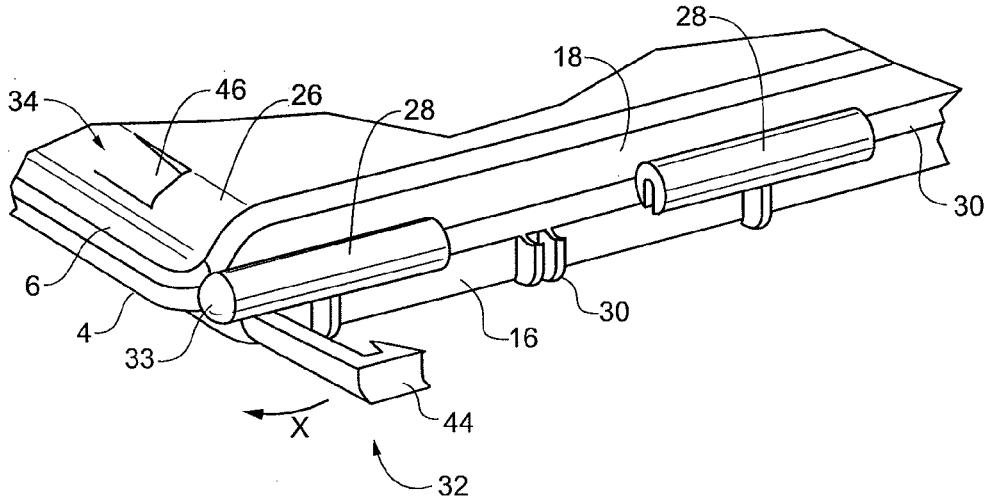
FIG. 8 is a perspective view of a portion of a foldable compact food tray according to still other embodiments of the present invention in a closed position.

FIG. 8 shows another kind of locking mechanism. Here, the locking members 32, 34 comprise a hook projection 44 and a corresponding hook receptacle 46. The hook projection 44 can project from the inner edge 16 of one of the panels 4, and the hook receptacle 46 can be defined in a side edge 26 of the other panel 6. The hook projection 44 and the hook receptacle 46 can cooperate to lock the panels 4, 6 in the open position. The hook projection 44 can be configured to flex slightly in direction X. As the tray 2 is being moved to the open position, the hook projection 44 can flex in direction X to allow panel 6 to be positioned generally parallel to panel 4. When the panels 4, 6 have been moved to the open position, the hook projection 44 can be released, causing the hook projection 44 to nest in the hook receptacle 46. The hook projection 44 exerts a force on the hook receptacle 46 in the plane defined by the tray 2 in the open position, and this force tends to resist ordinary torque exerted by food items on the tray 2. In this way, the hook projection 44 and the hook receptacle 46 can lock the panels 4, 6 in the open position. When a user is ready to unlock the panels 4, 6, he/she can flex the hook projection 44 in direction X and fold the panels 4, 6 such that the hook receptacle no longer aligns with the hook projection. Some embodiments can include locking members 32, 34 including both projections 36, 38, 40, 42 and hook projections 44 and hook receptacles 46.

Still further, the tray can optionally be equipped with magnetic locking members. For example, magnets attracted to each other may be mounted at the inner edges of the panels such that when the tray is opened, the magnets engage one another so as to lock the tray in the open position in the manner described herein.

Referring again to FIGS. 1A-1B and 2A-2B, certain embodiments of the tray 2 include a handle to permit easy transport of the tray 2. In some embodiments, the handle can be near the outer edges 20, 22 of the respective panels 4, 6. The handle, for example can be defined by distal lips (or flanges) 23 of the panels. In some embodiments, the panels 4, 6 can each have handle grips 48, 50 located proximate the respective outer edges 20, 22. When the panels 4, 6 are in the closed position, the handle flanges (and the optional grips 48, 50) can align to form a handle. When the panels 4, 6 are in the open position, the handle flanges (and the optional grips 48, 50) can serve as handles for users carrying food items. In some embodiments, the optional grips can be formed by a non-slip grip detail, e.g., formed of rubber, urethane, or the like, to enhance the gripping of the tray 2.

Figure 9:
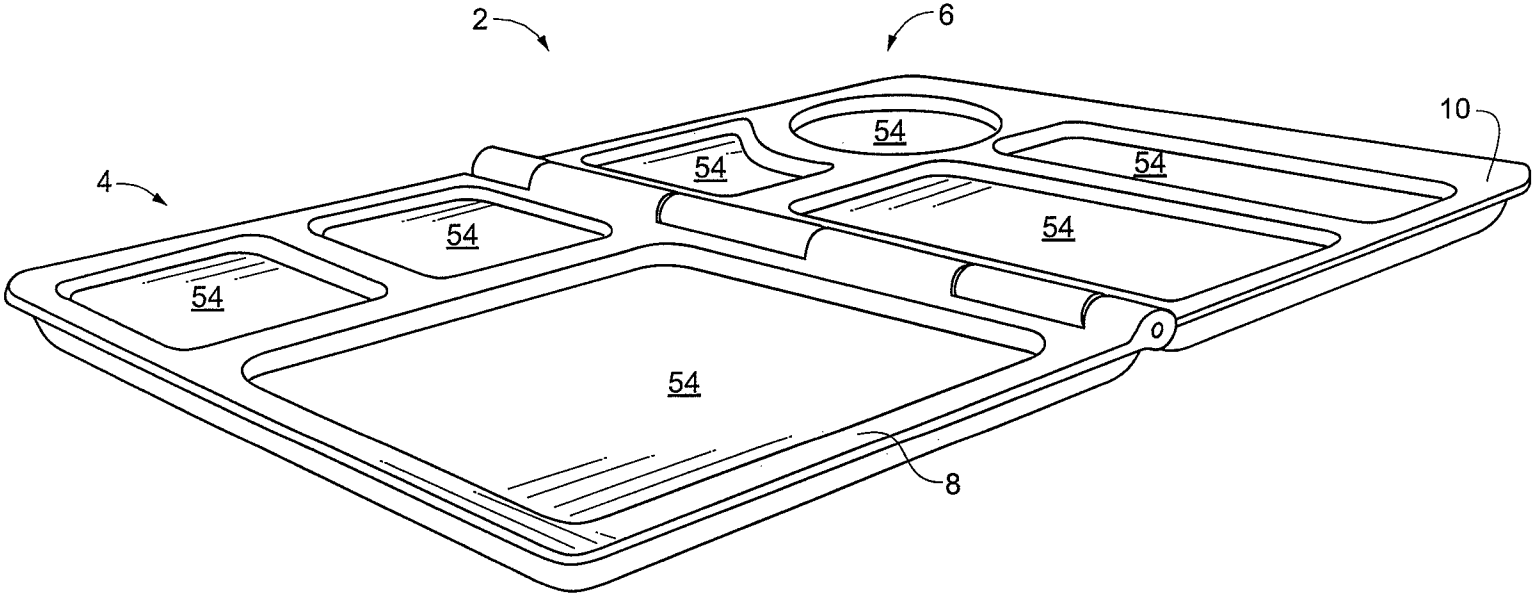
FIG. 9 is a perspective view of a foldable compact food tray according to embodiments of the present invention in an open position.
Figure 10A:
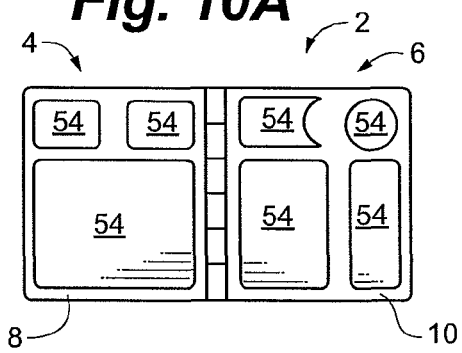
FIGS. 10A-10C are top views of variously configured foldable compact food trays according to embodiments of the present invention, each in an open position.
Figure 10B:
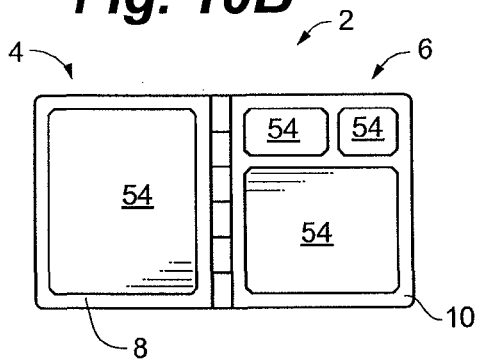
Figure 10C:
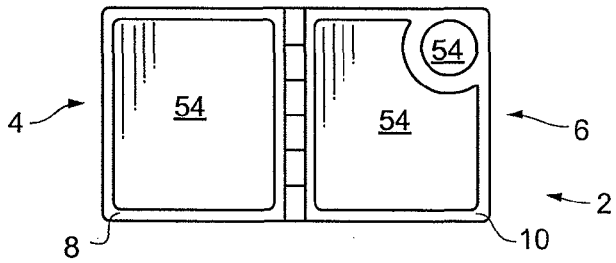

Referring to FIGS. 9, 10A-10C, and 11, trays 2 according to the present invention preferably include one or more compartments 54, which can assist users in organizing and transporting food items. In some embodiments, the upper surface 8, 10 of one or both panels 4, 6 can define one or more recessed compartments 54. In certain embodiments, each compartment has a depth of at least 0.1 inch, at least 0.2 inch, or at least 0.3 inch. FIG. 9 shows three compartments 54 defined in panel 4 and four compartments 54 defined in panel 6. FIGS. 10A-10C show additional configurations. As can be seen, one or more recessed compartments 54 can be defined in panel 4 and/or one or more recessed compartments 54 can be defined in panel 6. As can also be seen, in many embodiments, the arrangement and/or shape of recessed compartment(s) 54 defined in one of the panels 4, 6 differ from the recessed compartment(s) 54 defined in the other panel 4, 6.

Figure 11:
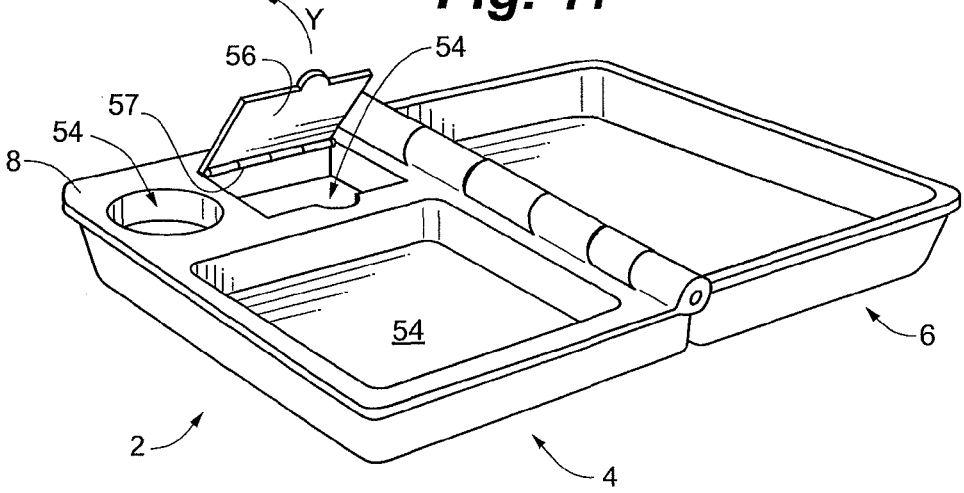
FIG. 11 is a perspective view of a foldable compact food tray according to embodiments of the present invention in an open position.

Referring to FIG. 11, in some embodiments, at least one of the recessed compartments 54 defined in one of the panels 4, 6 includes a lid 56. A hinge 57 can permit the lid 56 to move in direction Y. In some instances, wet wipes, napkins, etc. can be stored in the compartment 54 having the lid 56. Thus, the lid can configured to create an openable and closeable enclosure or compartment in which desired items can be stored.

Figure 13A:
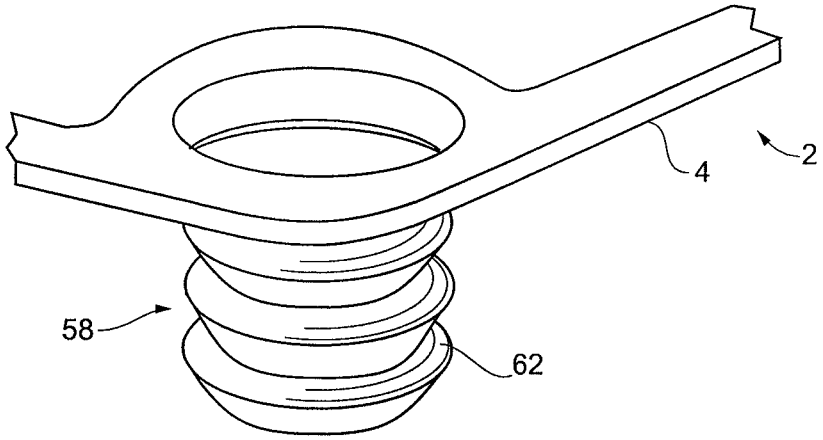
FIG. 13A is a perspective view of a cup holder according to embodiments of the present invention.
Figure 13B:
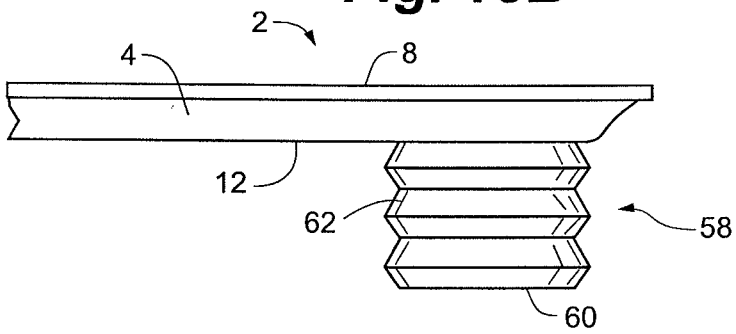
FIG. 13B is a side view of the cup holder of FIG. 13A.
Figure 13C:
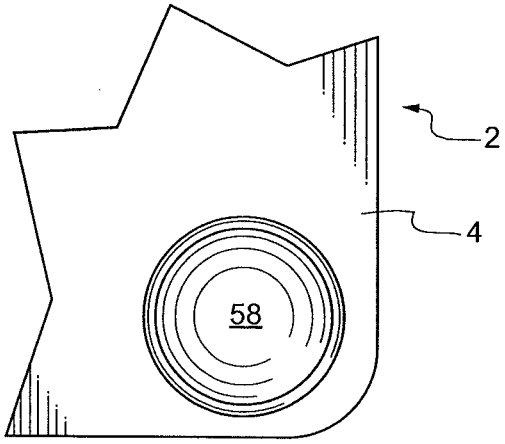
FIG. 13C is a top view of the cup holder of FIG. 13C.

Referring to FIGS. 13A-13C, some trays 2 can include a cup holder 58 to permit users to easily carry cups or other drinks while significantly reducing the risk of spilling. The cup holder 58 can extend through the upper and lower surfaces 8, 12 of one of the panels 4. The cup holder 58 can have a bottom surface 60 and at least one side surface 62. The side surface(s) 62 can have a generally circular cross-section, thereby providing a generally cylindrical cup holder 58. In some embodiments, the side surface(s) 62 can have a bellows configuration (FIGS. 13A-13B), a telescoping configuration, or other configuration that permits the cup holder 58 to expand and retract. The side surface(s) 62 can permit the bottom surface 60 to move between an expanded position in which the bottom surface 60 is away from the corresponding lower surface 12 and a retracted position in which the bottom surface 60 is near the corresponding lower surface 12.

Figure 12A:
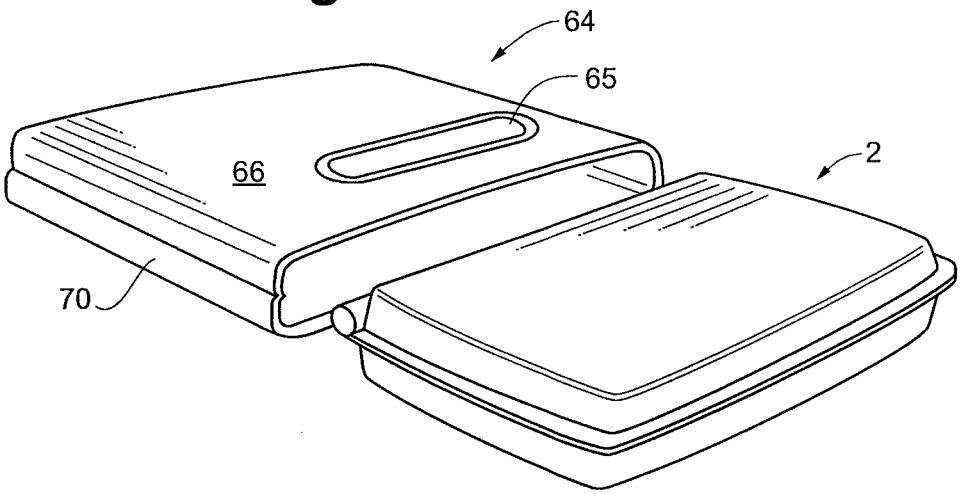
FIG. 12A is a perspective view of a compact food tray kit according to embodiments of the present invention.
Figure 12B:
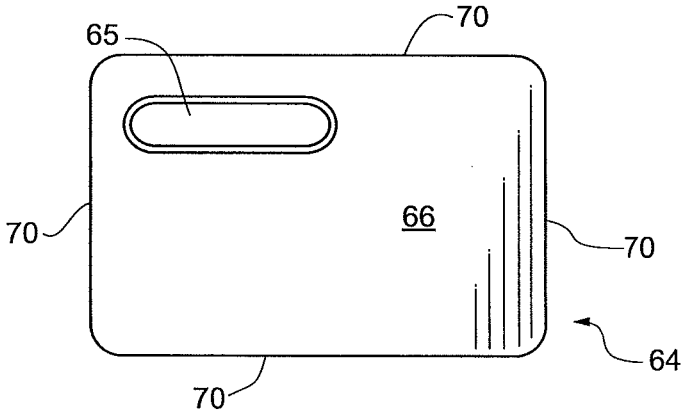
FIG. 12B is a top view of the pouch of FIG. 12A.
Figure 12C:
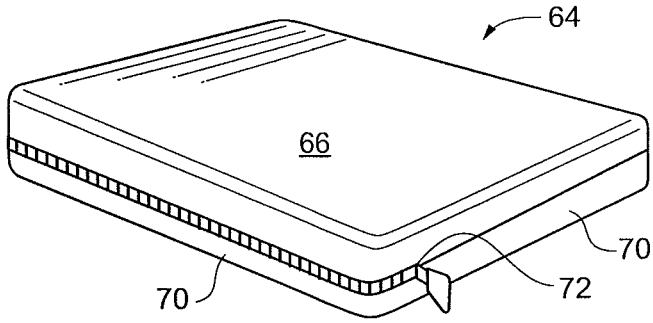
FIG. 12C is a perspective view of a pouch according to embodiments of the present invention.

Referring to FIGS. 12A-12C, in some instances, the tray 2 can be provided in combination with a pouch 64 to form a compact food tray kit. In some embodiments, the pouch 64 can include a clear window 65 for displaying a graphic printed in a corresponding location on the tray 2. The pouch 64 can separate the tray 2 from the surrounding environment (e.g., a user's backpack). This can enhance cleanliness, both in terms of the tray 2 dirtying the surrounding environment (e.g., separating a used tray from a user's books in a backpack) and vice versa (e.g., separating a user's exercise clothing from a clean tray. The pouch 64 can be sized to receive the tray 2 when in the closed position. In some embodiments, the pouch 64 can include two major surfaces 66, along with at least one edge surface 70. A pouch 64 with rectangular major surfaces 66 would likely have four edge surfaces 70, while a pouch 64 with rounded major surfaces 66 may have only a single edge surface 70. In some embodiments, the pouch 64 can be open on a portion of the edge surface(s) 70 to permit the tray 2 to be inserted into and removed from the pouch 64. In some embodiments, the pouch 64 can include a zipper 72, which can permit that portion of the edge surface(s) 70 to be opened and closed to enclose the tray 2 within the pouch 64.

In the foregoing detailed description, the invention has been described with reference to specific embodiments. However, it may be appreciated that various modifications and changes can be made without departing from the scope of the invention as set forth in the appended claims. Thus, some of the features of preferred embodiments described herein are not necessarily included in preferred embodiments of the invention which are intended for alternative uses.

What is claimed is:

1. A foldable food tray comprising:

a first rigid panel including a first panel upper surface, a first panel lower surface, a first panel inner edge, a first panel outer edge, and first panel side edges, the first panel further including (i) one or more first panel hinge members and (ii) one or more first panel locking members; and a second rigid panel having a second panel upper surface, a second panel lower surface, a second panel inner edge, a second panel outer edge, and second panel side edges, the second panel further including (i) one or more second panel hinge members and (ii) one or more second panel locking members, wherein the first panel hinge member(s) and the second panel hinge member(s) are operatively coupled to one another to permit the first and second panels to move between (i) a closed position in which the first and second panels are generally parallel to one another and the first panel upper surface and the second panel upper surface are facing one another, wherein the tray is not part of any other object such that the tray when in the closed position has a flat configuration defined by two opposed exposed planar major surfaces, defined respectively by the first panel lower surface and the second panel lower surface, that are substantially parallel to each other, and (ii) an open position in which the first and second panels are generally parallel to one another and lie in the same plane, and the first panel upper surface and the second panel upper surface are both facing the same general direction, and wherein the first panel locking member(s) and the second panel locking member(s) are configured to releasably lock the first and second panels in the open position, thereby preventing the first and second panels from inadvertently moving from the open position, the one or more first panel locking members include (i) a single first panel projection projecting away from the first panel inner edge and/or (ii) a pair of first panel projections spaced next to one another and projecting away from the first panel inner edge, the one or more second panel locking members include (i) a single second panel projection projecting away from the second panel inner edge and/or (ii) a pair of second panel projections spaced next to one another and projecting away from the second panel inner edge, and the single first panel projection cooperates with the pair of second panel projections to lock the first and second panels in the open position and/or the pair of first panel projections cooperate with the single second panel projection to lock the first and second panels in the open position.

2. The foldable food tray of claim 1, wherein:

the one or more first panel locking members include a plurality of single first panel projections and a plurality of pairs of first panel projections positioned alternatingly along the first panel inner edge, the one or more second panel locking members include a plurality of single second panel projections and a plurality of pairs of second panel projections positioned alternatingly along the second panel inner edge, and each single first panel projection cooperates with a corresponding pair of second panel projections and each single second panel projection cooperates with a corresponding pair of first panel projections to lock the first and second panels in the open position.

3. The foldable food tray of claim 1, wherein:

the first panel includes a first panel handle flange located proximate the first panel outer edge the second panel includes a second panel handle flange located proximate the second panel outer edge, and the first panel handle flange and the second panel handle flange align to form a handle when the first and second panels are in the closed position.

4. The foldable food tray of claim 1, wherein the first and second panels are both generally rectangular.

5. The foldable tray of claim 1, wherein the first panel upper surface and the second panel upper surface each define one or more recessed compartments, the recessed compartments collectively being configured to stably receive a meal for a person.

6. The foldable tray of claim 5, wherein the first panel upper surface defines multiple recessed compartments.

7. The foldable tray of claim 5, wherein the recessed compartment(s) defined in the first panel upper surface differ from the recessed compartment(s) defined in the second panel upper surface.

8. The foldable tray of claim 5, wherein at least one of the recessed compartments defined in the first panel upper surface includes a lid.

9. The foldable tray of claim 5, wherein the first panel includes (iii) a cup holder extending through the first panel upper surface and the first panel lower surface, the cup holder having a bottom surface and at least one side surface that permits the bottom surface to move between (A) an expanded position in which the bottom surface is away from the first panel lower surface and (B) a retracted position in which the bottom surface is adjacent to the first panel lower surface.

10. The foldable tray of claim 1 wherein the tray is provided with a pouch sized to receive the foldable tray when in the closed position.

* * * * *